United States Patent [19]

Pradt et al.

[11] 4,182,648

[45] Jan. 8, 1980

[54] OXYGEN PULPING PROCESS

[75] Inventors: Louis A. Pradt; William M. Copa, both of Wausau, Wis.

[73] Assignee: Sterling Drug Inc., New York, N.Y.

[21] Appl. No.: 409,960

[22] Filed: Oct. 26, 1973

Related U.S. Application Data

[63] Continuation-in-part of Ser. No. 224,340, Feb. 7, 1972, abandoned.

[51] Int. Cl.[2] ..... D21C 3/02

[52] U.S. Cl. ..... 162/38; 162/58; 162/65; 162/90

[58] Field of Search ..... 162/65, 61, 58, 38, 162/79, 40, 90; 8/111

[56] References Cited

U.S. PATENT DOCUMENTS

| | | | |
|---|---|---|---|
| 2,673,148 | 3/1954 | Harris | 162/65 |
| 2,926,114 | 2/1960 | Grangaard et al. | 162/65 X |
| 3,652,385 | 3/1972 | Noreus et al. | 162/65 X |
| 3,654,070 | 4/1972 | Pradt et al. | 162/65 X |
| 3,736,224 | 5/1973 | Grayson et al. | 162/65 |

*Primary Examiner*—Arthur L. Corbin

*Attorney, Agent, or Firm*—Thomas L. Johnson; B. Woodrow Wyatt

[57] ABSTRACT

An improvement in the delignification (pulping) of raw cellulose by treatment with oxygen and an alkaline buffer solution at elevated temperature and pressure, which comprises carrying out the process in an unflooded condition, that is, where contact between the raw cellulose and buffer solution is intermittent, both gaseous and liquid phases being present at all times. Optionally, cupric ion may be present as a catalyst.

12 Claims, No Drawings

OXYGEN PULPING PROCESS

This application is a continuation-in-part of our prior copending application Ser. No. 224,340, filed Feb. 7, 1972, now abandoned.

This invention relates to an improvement in the process of delignification of cellulosic raw material, and more particularly it is concerned with an improved process for the pulping of raw cellulose with oxygen.

It is known that cellulose pulp can be manufactured from wood chips or other fibrous raw materials by the action of oxygen in an alkaline solution. The pulping processes described in the art either take place in a continuous liquid phase, that is, the cellulosic raw material is completely immersed in the alkaline buffer solution, referred to herein as a "flooded" condition (Harris U.S. Pat. No. 2,673,143 and Grangaard et al. U.S. Pat. No. 2,926,114); or in a continuous gas phase wherein the alkaline solution has been completely absorbed by the raw cellulose, so called "gas phase pulping" (cf. Noreus et al. U.S. Pat. No. 3,652,385).

The present invention comprises a raw cellulose delignification process with a high pressure oxygen-containing gas in the presence of an alkaline buffer solution wherein both gaseous and liquid phases are present at all times and the alkaline buffer solution is applied to the raw cellulose so that contact therewith is intermittent. This condition is referred to herein as an "unflooded" condition.

It has been found that the delignification process when carried out under unflooded conditions according to the present invention affords a substantial improvement in the yield and quality of pulp as compared with the processes of the prior art carried out under flooded conditions.

In order to carry out the process under unflooded conditions, the raw cellulose is suspended in the oxygen-containing gas in a high pressure reaction vessel, and the alkaline buffer material allowed to trickle over the raw cellulose by gravity. The liquid buffer is applied to the raw cellulose and removed from the high pressure reaction vessel at such a rate that liquid droplets are present at all times and yet a flooded condition is avoided. Alternatively, the raw cellulose is suspended in the oxygen-containing gas in a shaking or rotating autoclave only partially filled with the alkaline buffer solution so that the raw cellulose is intermittently wetted with and drained of the solution.

The process can be carried out batch-wise, the reaction vessel being completely emptied after each run and then refilled with reactants before the next run; or it can be carried out continuously, the raw cellulose being introduced into the top of a vertical reaction vessel and the treated material withdrawn from the bottom, or, conversely, the raw cellulose being introduced into the bottom of the vessel and the treated material withdrawn from the top. In the continuous process the alkaline buffer solution can be recycled to the high pressure reaction vessel, spent buffer being withdrawn and fresh buffer added from time to time to the recycle liquid stream as needed. Further, the oxygen-containing gas can also be recycled to the high pressure reaction vessel, gas depleted in oxygen being withdrawn and fresh gas added from time to time to the recycle gas stream as needed.

The alkaline buffer solution can be any such solution conventionally used in pulping and bleaching processes.

Preferred alkaline buffer solutions are aqueous solutions of sodium hydroxide, sodium carbonate, sodium bicarbonate or mixtures thereof in which the sodium content ranges between about 1.5 and about 44.0 grams per liter. A particularly preferred alkaline buffer solution is aqueous sodium bicarbonate at a concentration between about 6 and about 160 grams per liter.

The oxygen-containing gas can be pure oxygen or oxygen mixed with an inert gas such as ordinary air. The pressure in the reactor or autoclave is such that the partial pressure of oxygen is between about 250 and about 700 psi.

The temperature at which the delignification process of the invention takes place is between about 130° and 190° C. The period of time the reactants are held at reactor temperature can range from about ten minutes to about ten hours.

A further aspect of the invention resides in carrying out the above-described process in the presence of cupric ion dissolved in the alkaline buffer solution, which affords increased yields of pulp as compared to the process when copper is absent. The cupric ion may be present in a concentration between about 8 and about 56 milligrams of copper per liter.

The following examples will further illustrate the invention without the latter being limited thereby.

EXAMPLE 1

Aspen wood chips were placed in a basket suspended in a pressure vessel. For flooded conditions the vessel was filled with alkaline buffer solution to a level above the top of the wood chips. For unflooded conditions, the alkaline buffer solution was allowed to occupy only the bottom portion of the vessel not covering the wood chips and the liquor was recycled to the top of the vessel and allowed to run down over the chips into the bottom of the vessel.

Air was admitted to the bottom of the vessel and vented from the top at a rate held between 0.4 and 0.6 liters (measured at standard temperature and pressure) per hour per gram of dry wood chips. The alkaline buffer solution was a solution of sodium bicarbonate at a concentration of 50 grams per liter, and the buffer solution and reactor were maintained at temperatures between 151° and 155° C. The liquor was recycled at a rate of between 2.0 and 3.4 liters per minute per gram of dry wood chips.

Copper sulfate was optionally added to the buffer solution to give a concentration of copper of 16 milligrams per liter.

The results of three flooded runs and three unflooded runs are as follows:

| | | Flooded | | |
|---|---|---|---|---|
| | | | Yield | |
| Time, hr. | Pressure psig | Catalyst | Pulp | Unpulped |
| 6 | 2020 | none | 41.1 | 10.1 |
| 2 | 2980 | none | 35.0 | 30.1 |
| 2 | 2990 | $CuSO_4$ | 38.6 | 19.1 |

| | | Unflooded | | |
|---|---|---|---|---|
| | | | Yield | |
| Time, hr. | Pressure psig | Catalyst | Pulp | Unpulped |
| 6 | 2025 | none | 44.4 | 5.4 |
| 2 | 2980 | none | 43.1 | 18.3 |
| 2 | 2980 | $CuSO_4$ | 51.5 | 11.3 |

The results showed that the unflooded condition produced a higher pulp yield and a lower amount of unpulped material at a given reaction time and pressure; and that catalytic quantities of copper shortened the time needed for a given pulp yield.

EXAMPLE 2

One thousand nine hundred sixty grams (on an oven dry basis) of aspen chips were charged to a reactor, and 10.4 liters of 50 g/l sodium bicarbonate were charged to a reservoir system. The reactor was pressurized with air to an oxygen partial pressure of 318 psi. The liquor was then recycled at a rate of 3860 ml/min over the wood chips in an unflooded condition and the liquor and reactor were then heated to a temperature of 152° C. The system was injected with air at the bottom of the reactor at a rate of 785 liters (S.T.P.) per hour. The same quantity of air was bled from the top of the reactor and exhausted to the atmosphere. These conditions were maintained for 6 hours. The system was then cooled and the pulped chips were screened through a 0.008 slot screen. An oven dry pulp yield of 44.4% was achieved, and the pulp had a permanganate number of 3.6 and a brightness of 50.3 (% G.E.).

EXAMPLE 3

One thousand six hundred twenty grams (oven dry basis) of aspen chips presoaked in sodium bicarbonate were charged to a reactor, and the reservoir was charged with 11.5 liters of 50 gm/l sodium bicarbonate. The system was then charged with air to an oxygen partial pressure of 420 psi, and the liquor recycled over the wood chips in an unflooded condition at 3860 ml/min. The system was then heated to 153° C. and the system pressure was raised to an oxygen partial pressure of 629 psi. Air flow through the reactor was maintained at 808 liters/hr. (S.T.P.). The system was operated under these conditions for two hours and was then cooled and the contents removed. The pulp was screened through a 0.008 inch slot screen. The yield was 51.5% of a pulp with a brightness of 55.4 (% G.E.).

EXAMPLE 4

Sixteen grams of aspen wood chips were placed in a basket in a shaking autoclave. The autoclave was charged with 120 ml of 50 gm/l sodium bicarbonate and 16.7 mg/l copper, added as copper sulfate. The autoclave was charged to an oxygen partial pressure of 750 psi and the temperature was raised to 140° C. This temperature was maintained for 5 hours during which time the autoclave was continuously shaken in such a manner that the chips were intermittently wetted with and drained of liquor. The system was then cooled and the contents removed. The resulting product removed from the autoclave consisted of a bleached fibrous product of 61.3% yield and a brightness of 80.7% G.E.

EXAMPLE 5

Sixteen grams of aspen wood chips were placed in a basket in a shaking autoclave. The autoclave was charged with 120 ml of 50 gm/l sodium bicarbonate and 16.5 mg/l copper, added as copper sulfate. The autoclave was charged to an oxygen partial pressure of 250 psi and the temperature was raised to 150° C. This temperature was maintained for 3 hours during which time the autoclave was continuously shaken in such a manner that the chips were intermittently wetted with and drained of liquor. The system was then cooled and the contents removed. The resulting product removed from the autoclave consisted of a bleached fibrous product of 50.8% yield and a brightness of 74.5% G.E.

EXAMPLE 6

Two thousand one hundred thirty grams of aspen chips were introduced to an unflooded reactor and 11 liters of 50 g/l sodium bicarbonate solution were placed in the liquor reservoir system of the reactor. The reactor was charged to an oxygen partial pressure of 417 psi and the system was heated to 151° C. Total oxygen partial pressure was 552 psi at this temperature. The liquor was recycled over the unflooded chips at the rate of 3860 ml/min. Air velocity through the reactor, countercurrent to liquor flow, was 1010 liters (S.T.P.) per hour. The reaction conditions were maintained for five hours after which the system was cooled and the pulped chips removed. Pulp yield was 52.5% and pulp brightness was 63.9% G.E.

We claim:

1. In the process for delignifying a cellulosic raw material by treating said material in a high pressure reaction vessel with high pressure oxygen-containing gas in the presence of alkaline buffer solution, the improvement which comprises carrying out the process in an unflooded condition where the alkaline buffer solution is applied to the raw cellulose so that contact of said solution with said cellulose is intermittent, gaseous and liquid phases both being present at all times.

2. The process according to claim 1 in which the process is carried out batch-wise.

3. The process according to claim 1 in which the cellulosic raw material is suspended in the oxygen-containing gas in the high pressure reaction vessel, and the alkaline buffer solution allowed to trickle over the cellulosic raw material at such a rate as to maintain the unflooded condition.

4. The process according to claim 3 in which the process is continuous, the cellulosic raw material being introduced into the top of the reaction vessel, and the treated material withdrawn from the bottom.

5. The process according to claim 3 in which the process is continuous, the cellulosic raw material being introduced into the bottom of the reaction vessel, and the treated material withdrawn from the top.

6. The process according to claim 3 in which the alkaline buffer is recycled to the high pressure reaction vessel, spent buffer being withdrawn and fresh buffer added to the recycle stream as needed.

7. The process according to claim 3 in which the oxygen-containing gas is recycled to the high pressure reaction vessel, spent gas being withdrawn and fresh gas added to the recycle stream as needed.

8. The process according to claim 1 in which the cellulosic raw material is suspended in the oxygen-containing gas in a shaking or rotating autoclave only partially filled with the alkaline buffer solution so that the cellulosic raw material is intermittently wetted with and drained of the solution.

9. The process according to claim 1 in which cupric ion is present in the alkaline buffer solution at a concentration of between 8 and 56 milligrams per liter.

10. The process according to claim 1 in which the oxygen partial pressure is between 250 and 700 psi.

11. The process according to claim 1 in which the temperature is between 130° and 190° C.

12. The process according to claim 1 in which the alkaline buffer solution is a solution of sodium bicarbonate in water at a concentration between 6 and 160 grams per liter.

* * * * *